US006434346B1

(12) United States Patent
Knott et al.

(10) Patent No.: US 6,434,346 B1
(45) Date of Patent: Aug. 13, 2002

(54) PRINTING AND PHOTOCOPYING DEVICE AND METHOD WHEREBY ONE TONER MARK IS SCANNED AT AT LEAST TWO POINTS OF MEASUREMENT

(75) Inventors: Joseph Knott, Tutzing; André Schwarkopf, Plienig; Peter Bremmer, Röhrmoos, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/600,464

(22) PCT Filed: Jan. 15, 1999

(86) PCT No.: PCT/EP99/00211

§ 371 (c)(1),
(2), (4) Date: Feb. 14, 2001

(87) PCT Pub. No.: WO99/36834

PCT Pub. Date: Jul. 22, 1999

(30) Foreign Application Priority Data

Jan. 16, 1998 (DE) ..... 198 01 521
May 15, 1998 (DE) ..... 198 21 922

(51) Int. Cl.[7] ..... G03G 15/00; G03G 15/08; G03G 15/10

(52) U.S. Cl. ..... 399/49; 399/27; 399/58; 399/60; 399/72

(58) Field of Search ..... 399/27, 49, 53, 399/58, 59, 60, 64, 72, 74

(56) References Cited

U.S. PATENT DOCUMENTS 5,773,827 A * 6/1998 Yazdy et al. ..... 399/27
5,966,573 A * 10/1999 Yu et al. ..... 399/160

* cited by examiner

*Primary Examiner*—Arthur T. Grimley
*Assistant Examiner*—Hoang Ngo
(74) *Attorney, Agent, or Firm*—Schiff Hardin & Waite

(57) ABSTRACT

The invention relates to an electrographic printing or photocopying device and method. A toner mark (10) is provided on a photoconductive drum and printed with toner using a developing station. The toner mark (10) is scanned by a sensor at two points of measurement (a1,a2). The amount of toner in a developing mixture consisting of two components depends upon the difference (ΔU) or the quotient of the amount of the signals of the sensor at both points of measurement. A device which is also disclosed enables the exact length of the toner mark (10) to be determined.

33 Claims, 10 Drawing Sheets

Fig. 2 A
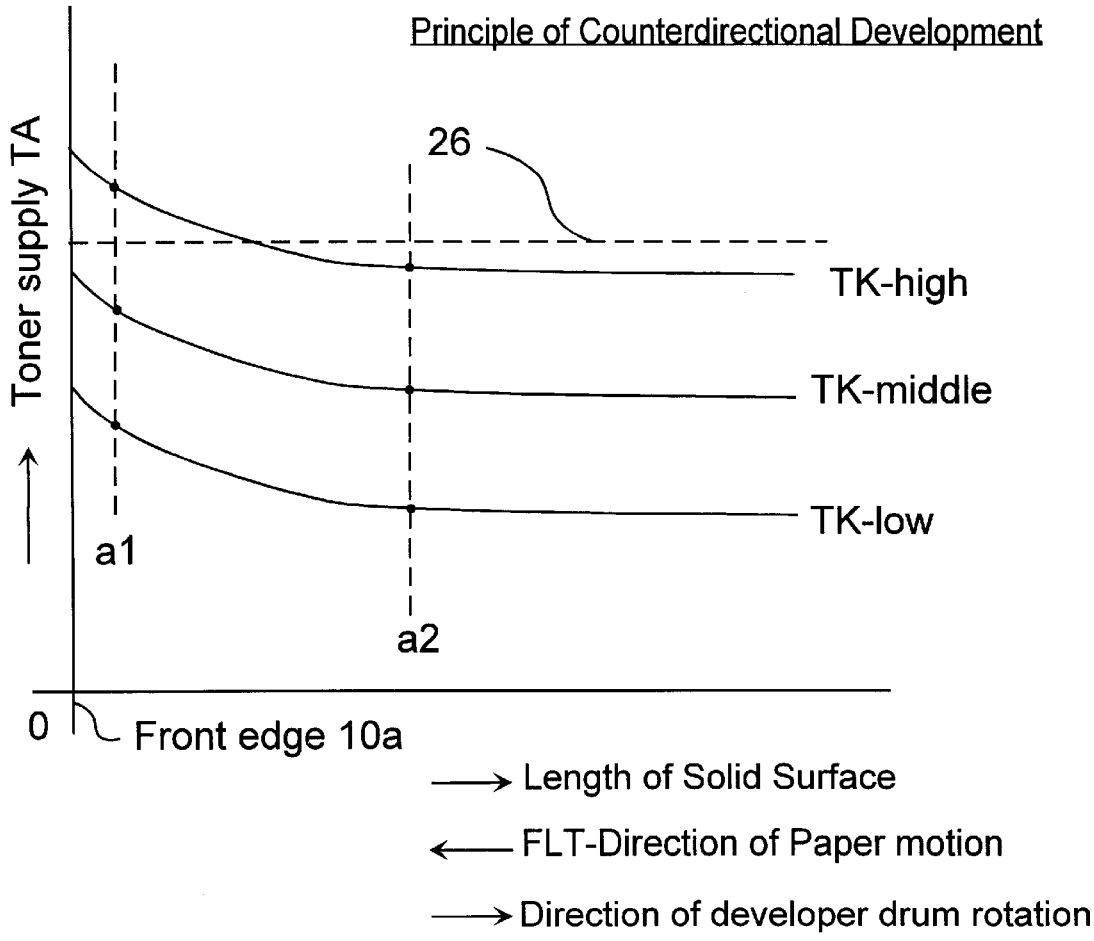
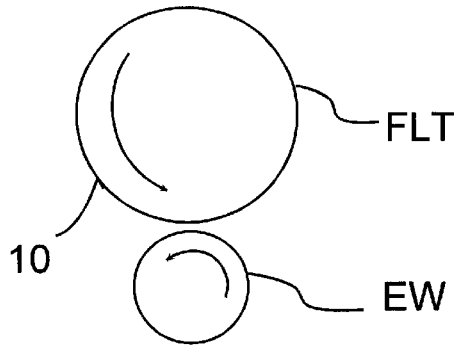
Fig. 2 B

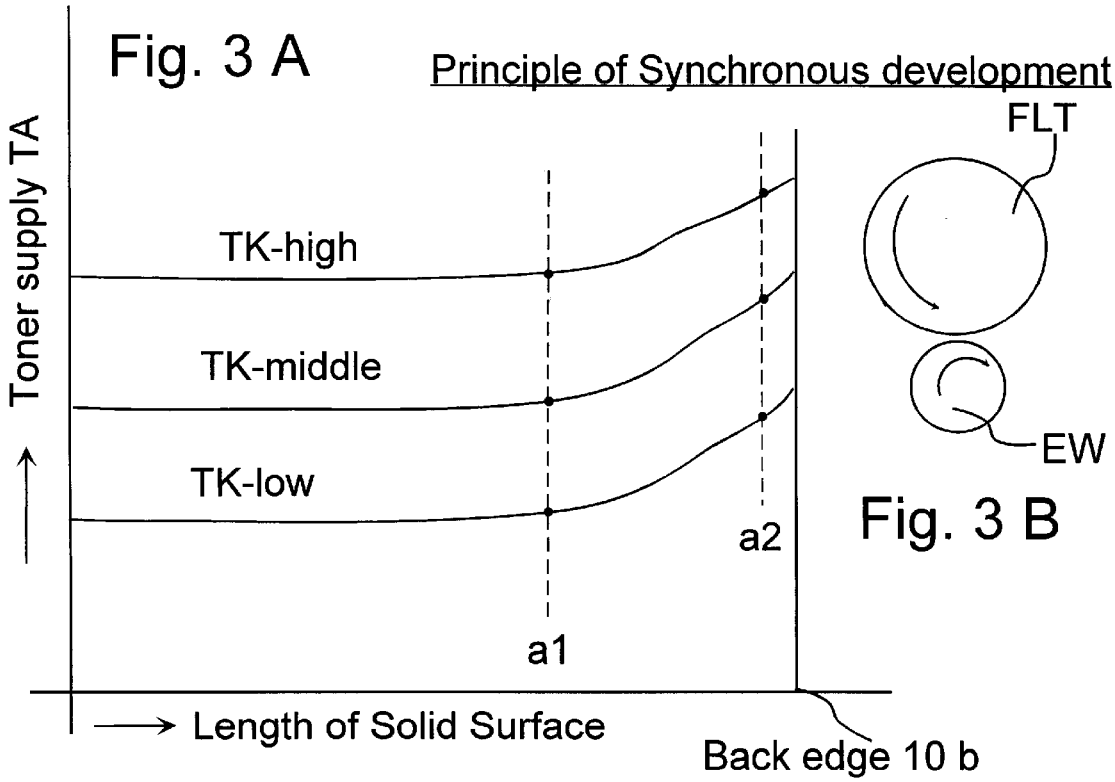
Fig. 3 A
Principle of Synchronous development
Toner supply TA
TK-high
TK-middle
TK-low
a1
a2
Length of Solid Surface
Back edge 10 b
FLT
EW
Fig. 3 B
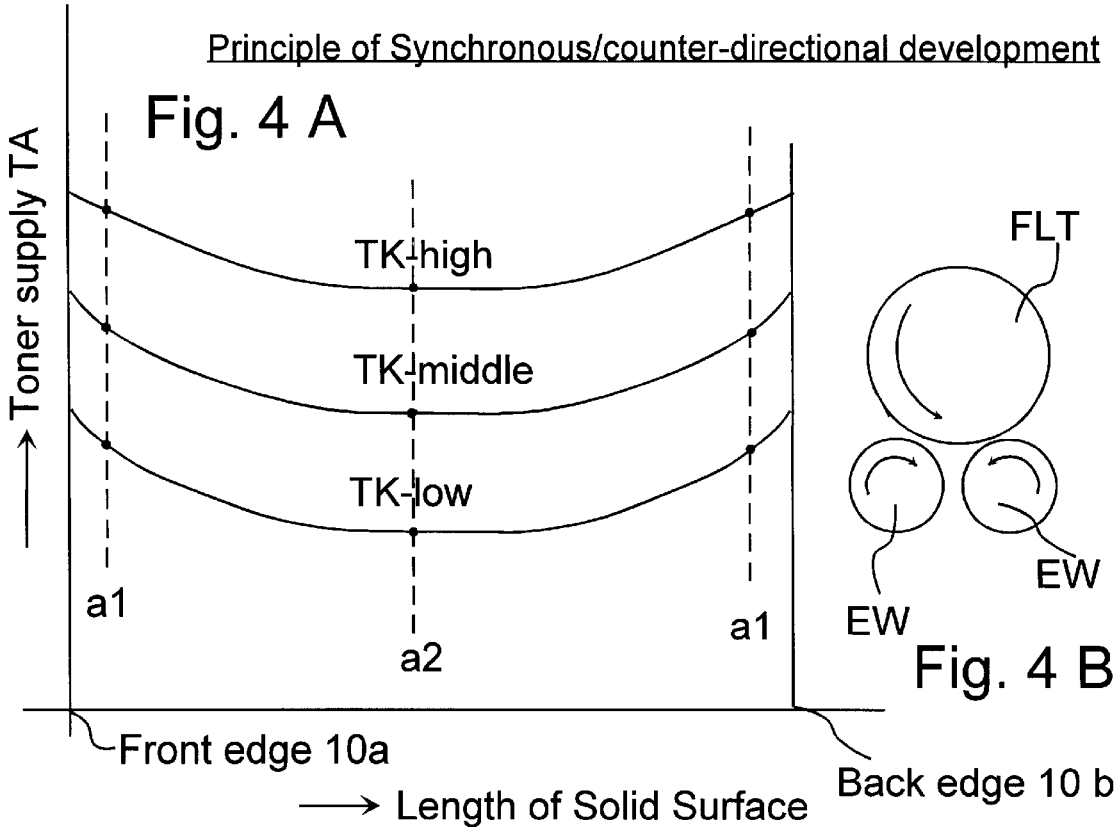
Principle of Synchronous/counter-directional development
Fig. 4 A
Toner supply TA
TK-high
TK-middle
TK-low
a1
a2
a1
Front edge 10a
Back edge 10 b
Length of Solid Surface
FLT
EW
EW
Fig. 4 B

PRINTING AND PHOTOCOPYING DEVICE AND METHOD WHEREBY ONE TONER MARK IS SCANNED AT AT LEAST TWO POINTS OF MEASUREMENT

BACKGROUND OF THE INVENTION

1. Field of the Invention

The present invention relates to a device for printing or copying in which least one toner mark on a toner carrier is inked with toner for monitoring and adjusting the toner surface coverage. The invention also relates to a method for printing or copying.

2. Description of the Related Art

A conventional printer or copier has a toner carrier, for instance a photoconductive drum, on which a latent image is generated, for instance by exposure of the drum with light. A developing station serves for inking the latent image with toner. This developer station contains a developer mixture of toner and a carrier, for instance magnetic iron particles, with an adjustable proportion of toner. In order to be able to check the toner surface coverage and adjust it, a toner mark is made on the toner carrier and is scanned, for instance using a reflex sensor.

The toner surface coverage in such a two-component developing system is essentially determined by the following factors:

a) the toner supply in the developer zone; i.e. at the contact surface of developer station and the surface of the toner carrier;

b) the toner concentration in the developer mixture;

c) the electrostatic charge behavior of the surface of the photoconductive drum;

d) the trieboelectric behavior of the developer mixture; that is, the force of the adhesion between carrier particles and toner;

e) the shape and size of the particles in the developer mixture;

f) the activity of the toner particles which are provided by the developer drum in the developer zone.

For a specific type of device, the factors c to f are relatively constant parameters. With respect to factors a and b, there is a mutual dependency; namely, the toner supply in the developer zone is dependent on the toner concentration, so that the contrast level of the latent image is determined by the toner concentration. This contrast level or the toner surface coverage area is proportional to the toner concentration.

In previous printers or copiers, the toner surface coverage has been adjusted by measuring the toner marks, for instance using a reflex sensor. The signals of the reflex sensor has then served as a measure of surface coverage; that is, the darker the inking of the toner marks with toner, the lower the signal level of the voltage of the receiver which picks up the reflected radiation. But this signal level is also dependent on the reflection behavior of the toner and of the character of the surface of the toner carrier, for instance of the photoconductor. Furthermore, the tolerances of the reflection sensor which scans the toner marks must be taken into account. It is therefore state of the art to perform an individual adjustment for each printer of the developer station, the toner carrier, and so on, to the toner material. When the toner type is changed and the toner carrier is replaced, this adjustment must always be performed again. In conventional printers, correction programs were installed to facilitate the adjustment work, which performed an automatic adjustment within particular bandwidths once the toner type and the type of photoconductive drum were inputted. But the result is frequently unsatisfactory despite these corrective measures, and a toner excess can set in, in which the toner layer on the toner carrier is thicker than necessary, which leads to excessive consumption of toner.

German Patent Document DE-A-39 38 354 teaches an image recording device in which a toner density sensor tests two toner marks on a photoconductive drum. The sensor contains two photoreceivers, which evaluate the degree of reflection of the two toner marks. The toner marks are arranged transverse to the direction of motion of the photoconductive drums, with one toner mark having a high density and the other toner mark, a low density. A bias voltage for the developer unit is set depending on the measurement result of the photoreceiver.

U.S. Pat. No. 5,410,388 teaches a device, or respectively, a method for electrographic printing or copying in which a densitometer determines the respective surface coverage at two consecutive measurement locations of an elongated toner mark using infrared radiation. When there is a difference between the surface coverage in the front region of the toner mark and the back region of the toner mark as expressed in a different degree of reflection, parameters of the development process are readjusted; for example, the toner concentration can be modified. If the difference in the reflection power or in the values of the surface coverage equals zero, then the developer process is left unchanged.

SUMMARY OF THE INVENTION

It is an object of the invention to provide a device and a method which reduce the adjustment outlay and which achieve a relatively high-quality print result.

This object and others are achieved for devices by claims 1, 13, 22, 30 & Sub.

The invention makes use of an effect that occurs in the inking of a solid surface with toner in the direction of motion of the toner carrier in two-component developer mixtures. As viewed in the direction of motion of the toner carrier, the toner supply within the developer zone changes. At first the toner supply is large, which leads to a high surface coverage. When this first supply of toner has been transferred to the toner carrier, then new toner must first be transported by the developer drums to replace it, which leads to a reduction of surface coverage given low the toner concentration. After the initial drop in toner supply, the supply of toner as seen across the length of the toner mark remains constant, and thus a constant surface coverage also sets in. In this regard, one refers to a depletion effect in the solid surface in the direction of motion of the toner carrier. This depletion effect manifests itself in a reduction of the surface coverage, until saturation is achieved; that is, within the depletion zone the surface coverage is 100% on the toner mark. Given this degree of surface coverage, the toner mark is covered with toner densely without gaps; given a black toner, increasing the layer thickness of the toner does not produce any additional blackening. The fluctuations in surface coverage along the toner mark are inversely proportional to the toner concentration. The higher the toner concentration, the smaller the differences in surface coverage, or respectively, contrast level on the toner marks.

The toner marks that have been inked with toner are now inventively scanned by at least one sensor at at least two consecutive measurement points as seen in the direction of the motion of the toner carrier, and the surface coverage at these measurement points is imaged as electrical signals.

The proportion of toner in the developer mixture is adjusted dependent on the difference or the quotient of the absolute values of the signals at these two measurement points. Thus, it is not the absolute level of the signal of the sensor which is evaluated, but rather the difference in the signals, or respectively, the quotient of the signals, that is measured along the toner marks. This difference, or respectively, the quotient, is largely independent of the reflection power of the utilized toner, and it is therefore unnecessary to perform different adjustments for different types of toner. The reflection power of the surface of the toner carrier—for instance of the surface of a photoconductive drum, or that of a carrier material made of paper—on which the toner mark is printed and then scanned enters into the result only slightly, in particular when calibration is performed to the reflection behavior of the respective surface, as described below.

When the proportion of toner in the developer mixture is adjusted in such a way that the difference is close to zero or the quotient is close to one, then almost no fluctuation of the surface coverage occurs over the length of the toner mark. In this operative state, an optimal contrast level is guaranteed without a toner excess.

One exemplifying embodiment is characterized in that the difference or the quotient of the signals at the two measurement locations is compared to a desired value, and that, depending on the comparison, a controller actuates a conveyor mechanism that transports toner to the developer station. This creates a control system which ensures that the printer is always held in an optimal operating state with high-quality print results. A value close to zero is selected as desired value for a difference evaluation, and a value close to one is selected for a quotient evaluation. When the control process commences given a certain toner deficit—that is, the difference is greater than zero or the quotient is not equal to one—then the subsequent control process ensures that an operating state with a toner surplus does not set in, since a certain deviation to the desired value remains. A time-point controller is preferably used as the controller, which switches the conveyor mechanism back and forth between the ON and OFF states.

In the above described device and evaluation method, it is essential that the relative position of the measurement locations on the toner mark remain the same. Mechanical assembly tolerances of the toner carrier or the sensor can lead to changes in the distance between the toner carrier and sensor. Such position changes can also occur when the toner carrier or the sensor is replaced. When the toner mark is now scanned by the sensor following a predetermined delay period in which the toner mark that has been inked with toner is moved forward subsequent to the writing of the latent images until it reaches the sensor, not always the same locations of the toner mark are measured. As a result, the setting obtained from the electrical measurement signals of the sensors is no longer optimal. Accordingly, INSERT CLAIMS 22 & 23 a device and a method are provide, which permit scanning of the toner mark at measurement locations whose position relative to the toner mark is constant.

In accordance with this aspect of the invention, the reference time at which a reference point on the toner mark passes the scanning sensor is fixed by a stationary scanning sensor, which is preferably the same sensor that scans the toner mark at the two measurement locations. The front edge or back edge of the toner mark is preferably used as a reference point. The additional times at which the two measurement locations are scanned can be specified dependent on this reference time given knowledge of the transport speed of the toner carrier. These measurement locations are then scanned in each toner mark with respect to the reference point at defined intervals from this reference point.

The described part of the invention is preferably used when the evaluation of the electrical signals occurs in accordance with the above described device and method. But it can also be used advantageously to fix the position of a toner mark that is scanned at two measurement locations.

BRIEF DESCRIPTION OF THE DRAWINGS

An exemplifying embodiment of the invention is detailed below with the aid of the drawing.

FIG. 2A is a graph of a characteristic field of the toner supply over the length of a solid surface in the principle of counter-directional development and FIG. 2B is side view of toner applying rollers FIG. 3B shows a graph of a characteristic field as shown in FIG. 2, for the principle of synchronous development and FIG. 3B is a side view of the toner rollers;

FIG. 4A is a graph which shows characteristic field as shown in FIG. 2, for the principle of synchronous/counter-directional development and FIG. 4B is a side view of the rollers;

DETAILED DESCRIPTION OF THE PREFERRED EMBODIMENTS

Figure 1B:
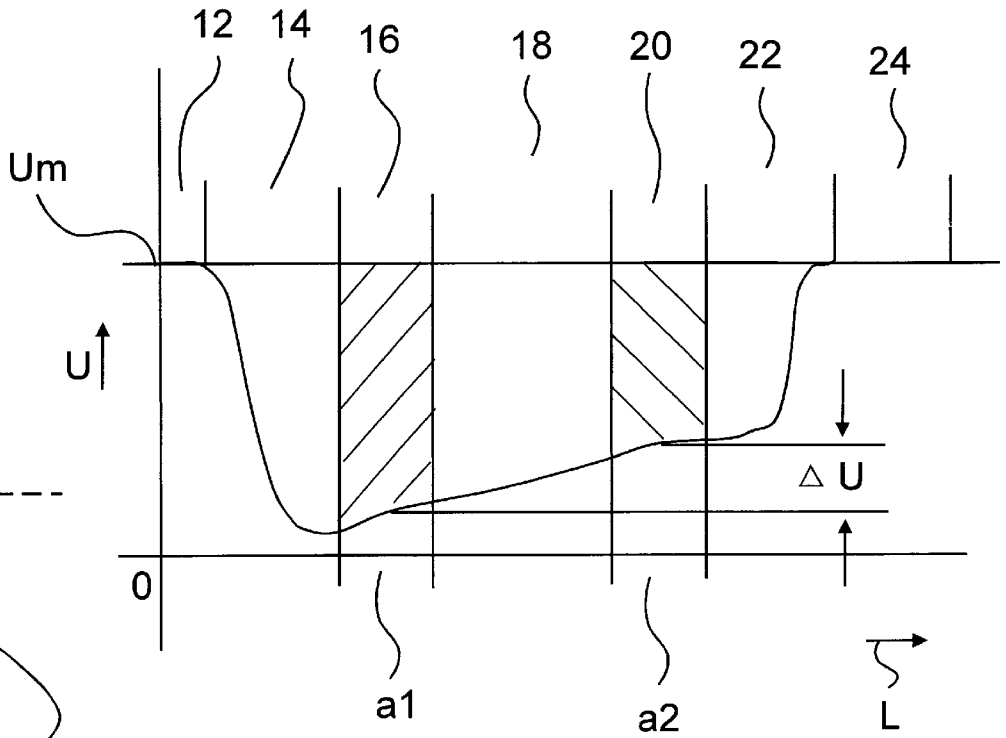
FIG. 1A is a plan view and FIG. 1B is a graph of the toner mark with two measurement locations and the characteristic curve of a sensor voltage over the length of the toner mark.
Figure 1A:
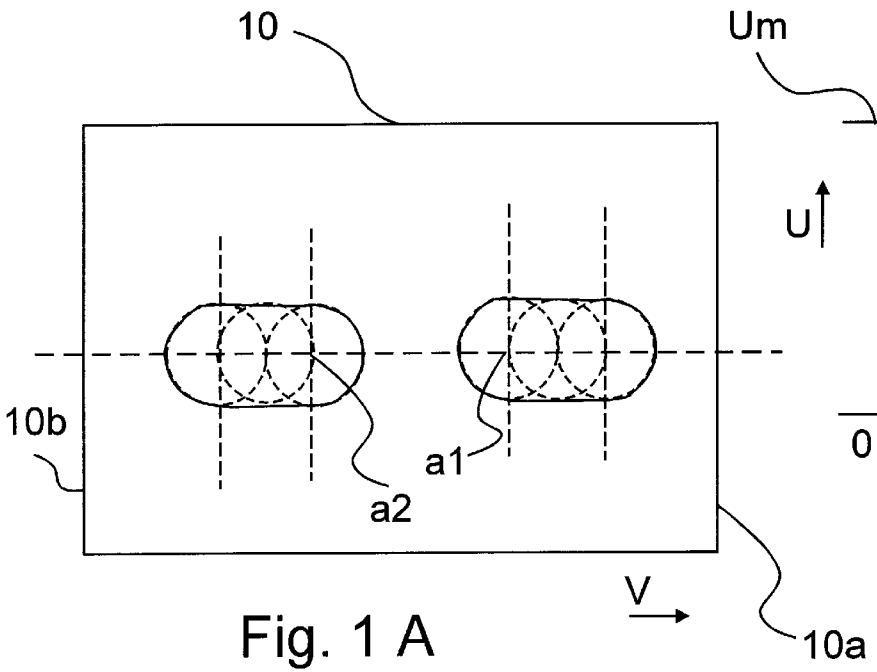

FIG. 1*a* shows a rectangular toner mark 10 whose longitudinal extent runs in the direction of motion of a photoconductive drum. The toner mark 10 which is provided with toner is scanned at two measurement locations a1 and a2. By virtue of the longitudinal motion of the photoconductive drum, given a circular beam spot a planar extension of the measurement locations a1 and a2 arises in the manner of an elongated hole. The measurement location a1 lies approximately in the middle of the first third of the toner mark 10, and the measurement location a2 lies approximately in the middle of the last third.

FIG. 1B shows a diagram of the curve of the voltage U of a radiation receiver over the length L of the toner mark 10. The radiation receiver (not shown) captures the radiation that is reflected by the toner mark 10 and the surface of the photoconductive drum (likewise not shown) and converts it into a voltage U, possibly after amplification. In a first portion 12 of the curve, radiation of the reflex sensor is reflected by the blank surface of the photoconductor with a high reflection power, producing a maximum voltage level Um, which is used as a reference level.

When the toner mark 10 moves forward in the direction indicated by the arrow at velocity v, the radiation sensor captures the front edge 10*a* of the toner mark 10, whereby the reflected radiation and thus the voltage U as well decrease. In section 14 a minimum of the voltage curve occurs when the beam spot lies completely within the toner mark 10 after the front edge 10*a* has passed. Section 14 is followed by section 16, which is characterized by capture of the measurement location a1. The voltage curve rises slightly in this region. The reason for this is explained later. In section 18 the voltage U rises further. In section 20 the measurement location a2 is scanned. In section 22 the measurement spot covers the back edge 10*b*. By virtue of the high reflection of the surface of the photoconductive drum, the voltage U continues to rise until reaching the maximum value Um in section 24. The difference value ΔU represented in the Figure is inventively evaluated. Preferably, the average voltage values U at the measurement locations a1 and a2 are advantageously taken into account.

FIG. 2A shows in a diagram that, in the principle of counter-directional development, the toner supply TA decreases over the length of a solid surface, for instance the toner mark 10. In this principle of counter-directional development, photoconductive drum FLT and developer drum EW have opposite directions of rotation, as is illustrated schematically at FIG. 2B. When the toner mark 10 reaches the developer drum EW with its front edge 10*a*, then there are many toner particles immediately available for transfer onto the photoconductive drum FLT; that is, the toner supply TA is high. After the first toner particles are delivered, the toner supply TA grows depleted, and only the number of toner particles that are subsequently transported to the developer drum EW by the developer station are transferred. A drop occurs in the toner supply TA, as expressed by the three characteristic curves, which relate to high, average, and low concentrations of toner TK. A measurement location, for instance the measurement location a1, should be arranged in the region of this drop. After a particular length the amount of toner that is subsequently transported is constant; the characteristic curves run approximately parallel to a broken saturation curve 26, at which 100% inking of the toner mark 10 with toner has occurred, which means that, given black toner, there is no additional blackening in the print even when the toner particles per unit area are increased. The measurement location a2 is arranged in this region of the largely parallel characteristic curves. As can be seen in the characteristic field, the drop of the toner supply TA in the initial region is steeper, the lower the toner concentration TK is. Accordingly, the difference in the reflection behavior at the two measurement locations a1 and a2 is also greater, and as a result the difference voltage ΔU is also greater.

FIG. 3A shows a similar characteristic field as FIG. 2, though for synchronous development, in which the directions of rotation of the photoconductive drum FLT and the developer drum EW are the same. By virtue of the parallel rotation motion, an elevated toner supply occurs at the back edge 10*b* of the toner mark 10, since the developer drum EW turns at a greater speed than the photoconductive drum FLT. Here, too, the measurement locations a1 and a2 are arranged one in the rectilinear part of the characteristic curve and one in the part of the curve that drops off relatively sharply.

FIG. 4A relates to characteristic curves of the toner supply TA over the length of the toner mark 10 in a principle of synchronous/counter-directional development, in which two developer drums EW are moved in opposite directions as shown in FIG. 4B. A falling curve of the toner supply TA occurs in the vicinity of the front edge 10*a* and the back edge 10*b*. The measurement spot a1, or respectively, a1', is arranged in the decreasing region of the curves; the measurement location a2 in the flat region.

Figure 5:
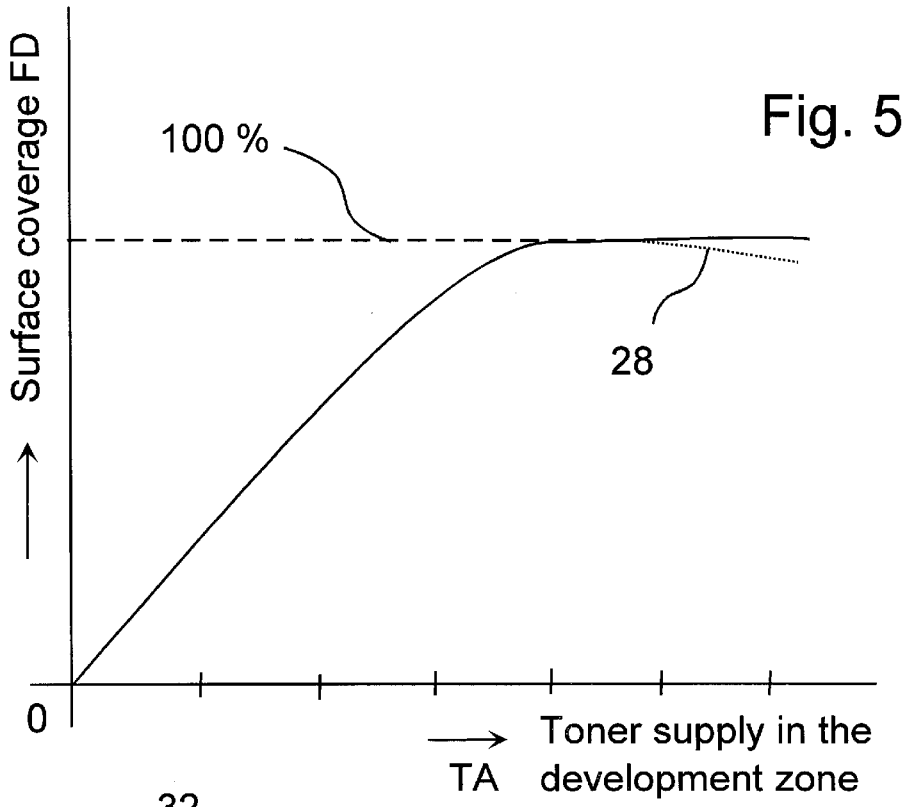
FIG. 5 is a graph of the relation between surface coverage and toner supply in the development zone.

FIG. 5 shows the relation between surface coverage FD at a solid surface, such as a toner mark 10, and the toner supply TA in the developer zone. Given a low toner supply TA, the surface coverage FD is also low. This surface coverage increases up to 100% as the toner supply rises. A surface coverage of 100% means that the toner mark 10 is completely covered with toner, and there are no gaps enabling the surface of the photoconductive drum to show through. When additional toner layers are built up given a surface coverage of 100%, the blackening in the print is no longer elevated as a consequence. Interestingly, after a surface coverage FD of 100% is achieved and the toner supply TA has risen, in many printers a course corresponding to the curve 28 is detected, whereby the surface coverage FD decreases again. This may be attributable to a clumping and to irregularities in the toner layer structure, so that layers emerge which cancel out the complete surface coverage again.

Figure 6:
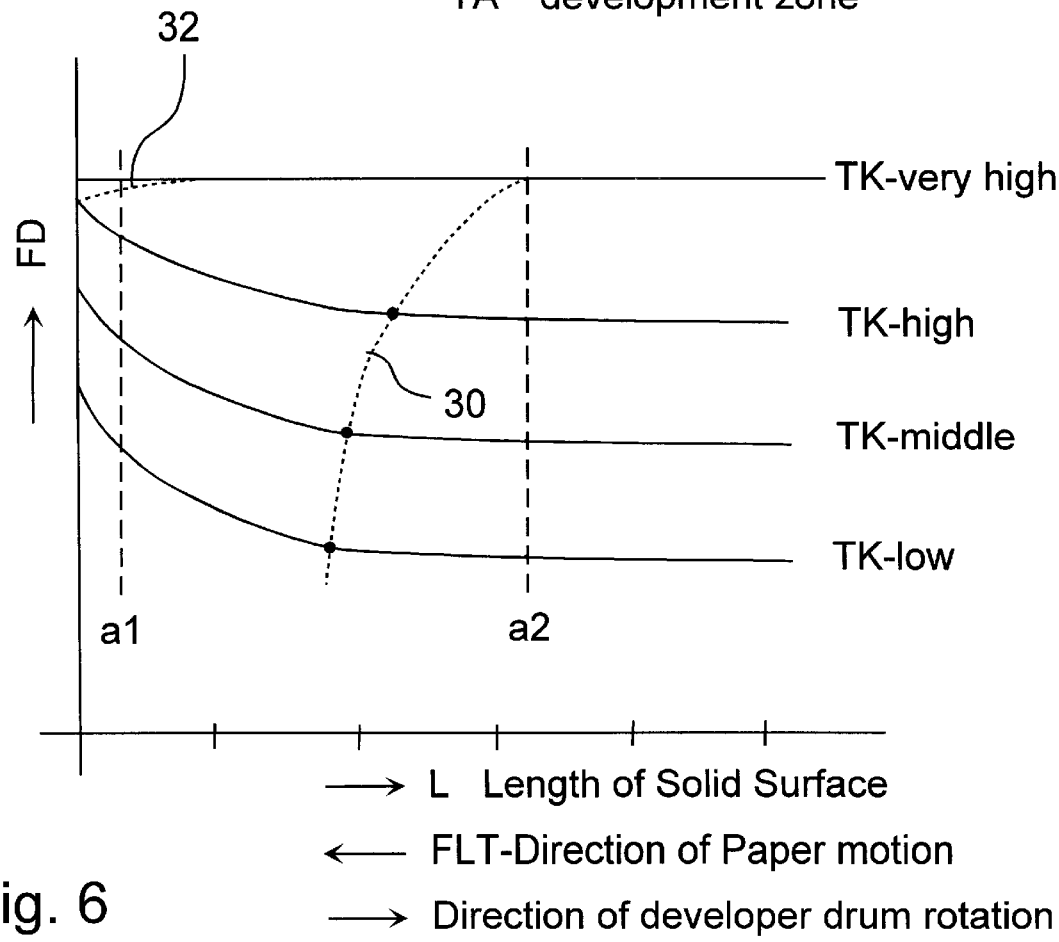
FIG. 6 is a graph of the surface coverage over the length of a solid surface given different toner concentrations.

FIG. 6 shows the arrangement of the measurement locations a1 and a2 for counter-directional development. As stated, one measurement location al must be arranged in the region of the falling curve, while the other measurement location a2 must be arranged in the rectilinear region of the curve. The curve 30 shows points of intersection with curves of different toner concentrations TK, whose appertaining lengths L define the measurement locations for a2. For practical reasons, the measurement location a2 is fixed to the right of the curve 30 at relatively large length L.

It can also be seen in FIG. 6 that, for very high toner concentrations TK, the curve for the surface coverage FD has a straight course; that is, the curve does not fall off but rather can even rise in the initial region, as indicated by section 32. Thus, given very high toner concentrations, a uniformly dense surface coverage of approximately 100% over the length of a solid surface occurs.

Figure 7A:
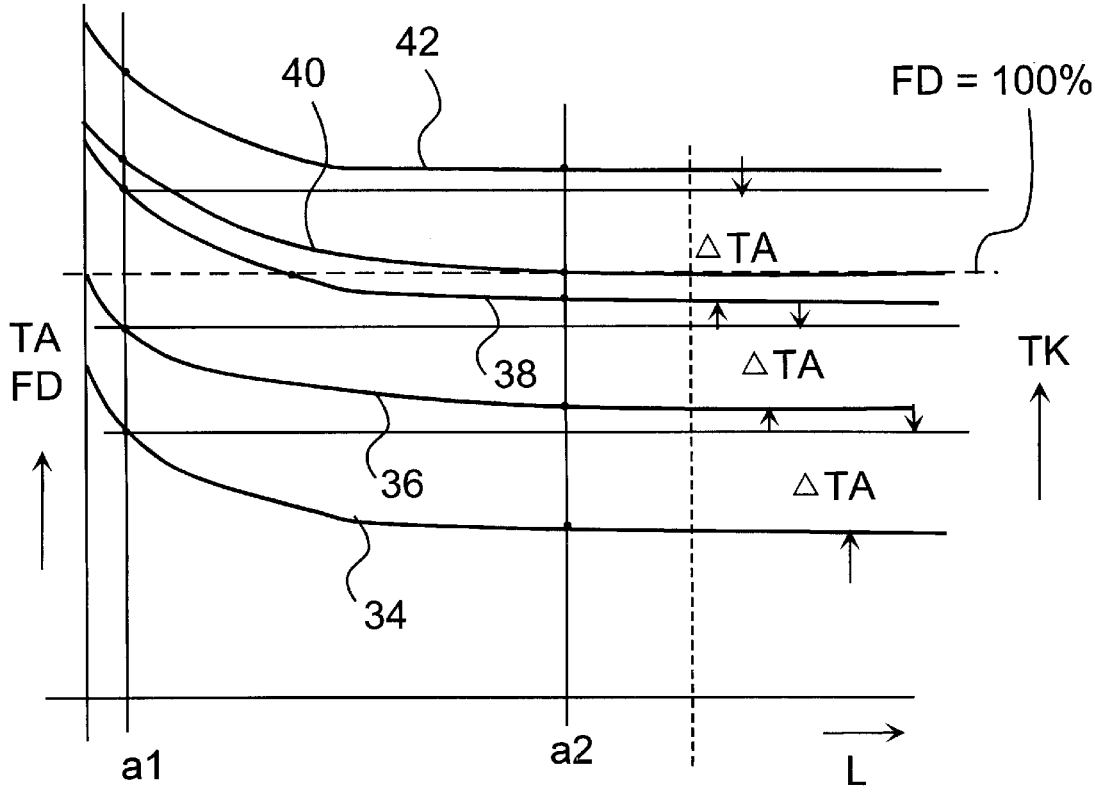
FIG. 7A is a graph of the relation of the surface coverage over the length of a toner mark for different toner concentrations and FIG. 7B is a plan view of two toner marks showing the scanning location shown in FIG. 7A.
Figure 7B:
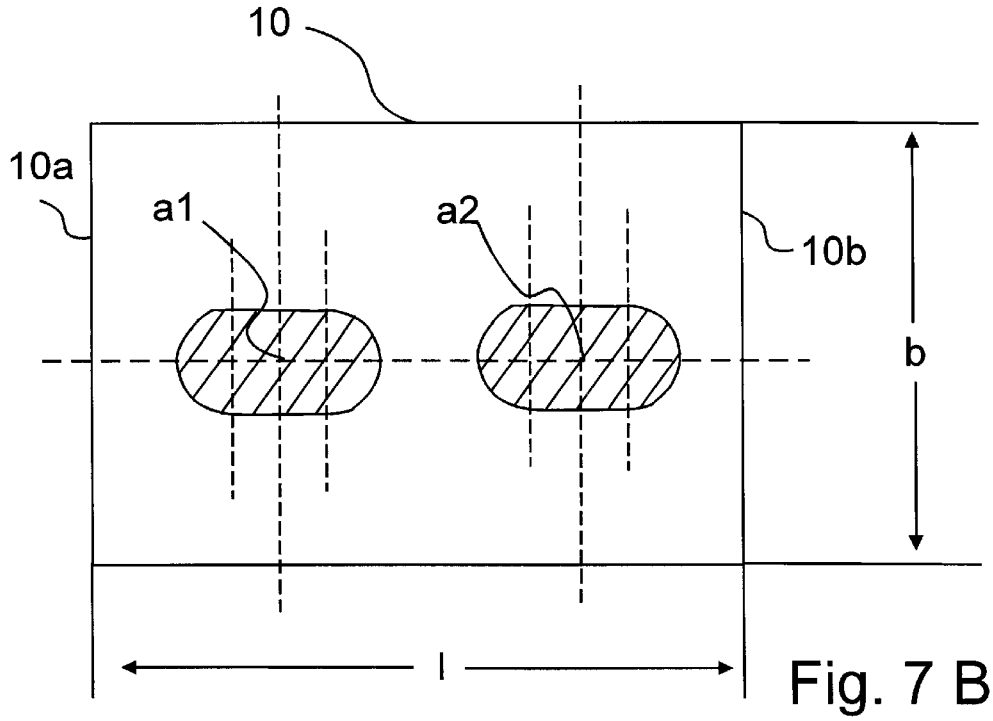

FIGS. 7A and 7B show shows a practical example of the relation between toner supply TA and surface coverage FD over the length L given various toner concentrations TK, whereby the bottommost curve 34 has a low toner concentration. The curves 36, 38, 40 and 42 show increasing toner concentrations TK, with the curve 42 being related to a very high toner concentration TK, for instance 7 percent by weight or more. The toner mark 10 has a typical length 1 of 8 to 16 mm and a width b of 4 to 10 mm. Differences ΔTA in the toner supply occur at the measurement locations a1 and a2, which differences increase with rising toner concentration TK.

The reflection behavior $R_T/R_{FLT}$ can be computed for every toner color and every photoconductive drum and then taken into account in an evaluation, for instance in the form of a correction table. The respective voltage difference ΔU can be corrected in order to account for different toner types. It has proven advantageous in practice that the quotient $R_T/R_{FLT}$ is very small, since the reflection power of the respective toner is negligible compared to the reflection power of the surface of the photoconductive drum. For instance, the value $R_T/R_{FLT}$ is approximately 1/300 for black toner and 1/10 for strongly reflected toner such as yellow or red toner. The error resulting from the different reflection powers of different toner colors is thus relatively small.

Figure 8:
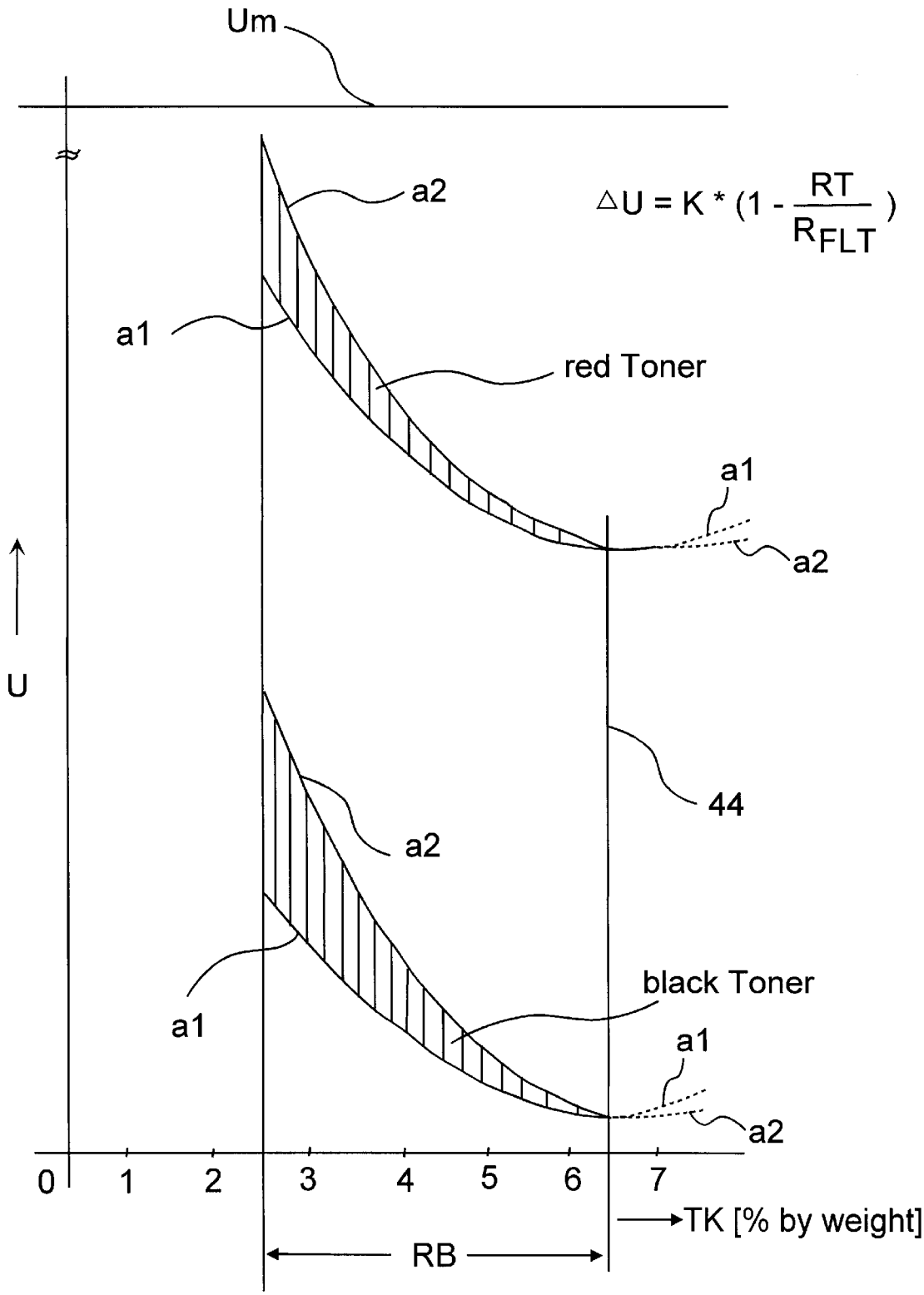
FIG. 8 is a graph of the voltage delivered by a reflex sensor against the toner concentration for black and red toner.

It is clear from FIG. 8 that for rising toner concentration TK, the voltage differenceU tends to zero. A practical control range RB emerges from approximately 2.3 to 6.6 percent by weight of toner. To the right of curve 44 there is a toner excess, whereby the voltage difference ΔU reverses itself. This region of toner excess is avoided when the control process is begun to the left of curve 44 and is continued up to a desired value slightly greater than zero.

Figure 9A:
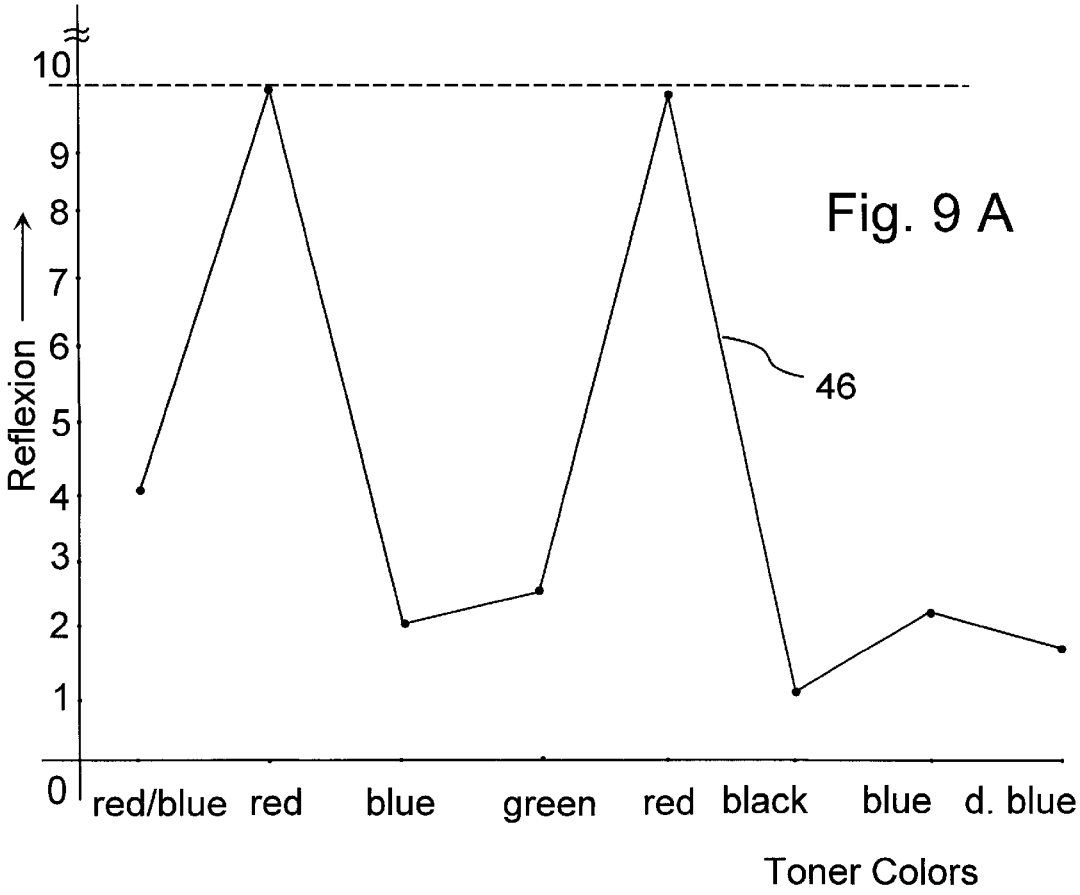
FIG. 9A is a graph of the reflection power of different toner colors and FIG. 9B is a graph of the degree of surface coverage for these various toner colors given controlling of the toner concentration.
Figure 9B:
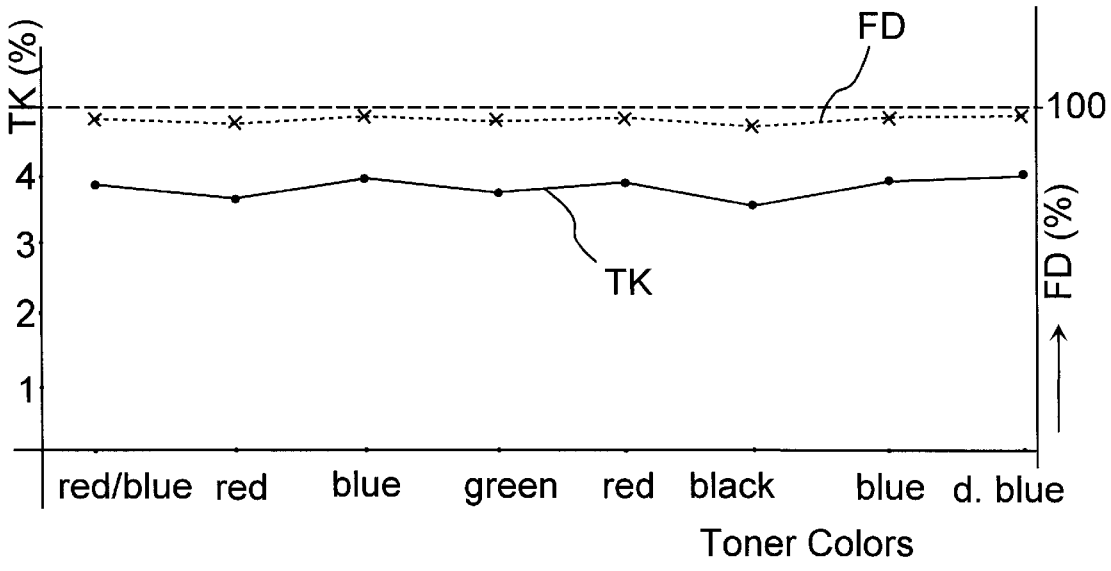

FIG. 9A shows a comparison of the reflection power of different toner types as expressed by the curve 46, where the surface coverage FDD is assumed to be nearly 100%. In FIG. 9B, the result of a control process accounting for the voltage difference ΔU is shown. A value at which the surface coverage FD is close to 100% is prescribed as a desired value. A relatively constant value of the surface coverage FD occurs for differently colored toners, regardless of the absolute reflection power and the absolute values of the voltage U that is generated by the radiation sensor. By contrast, the curve of the toner concentration TK fluctuates for different toner colors.

Figure 10:
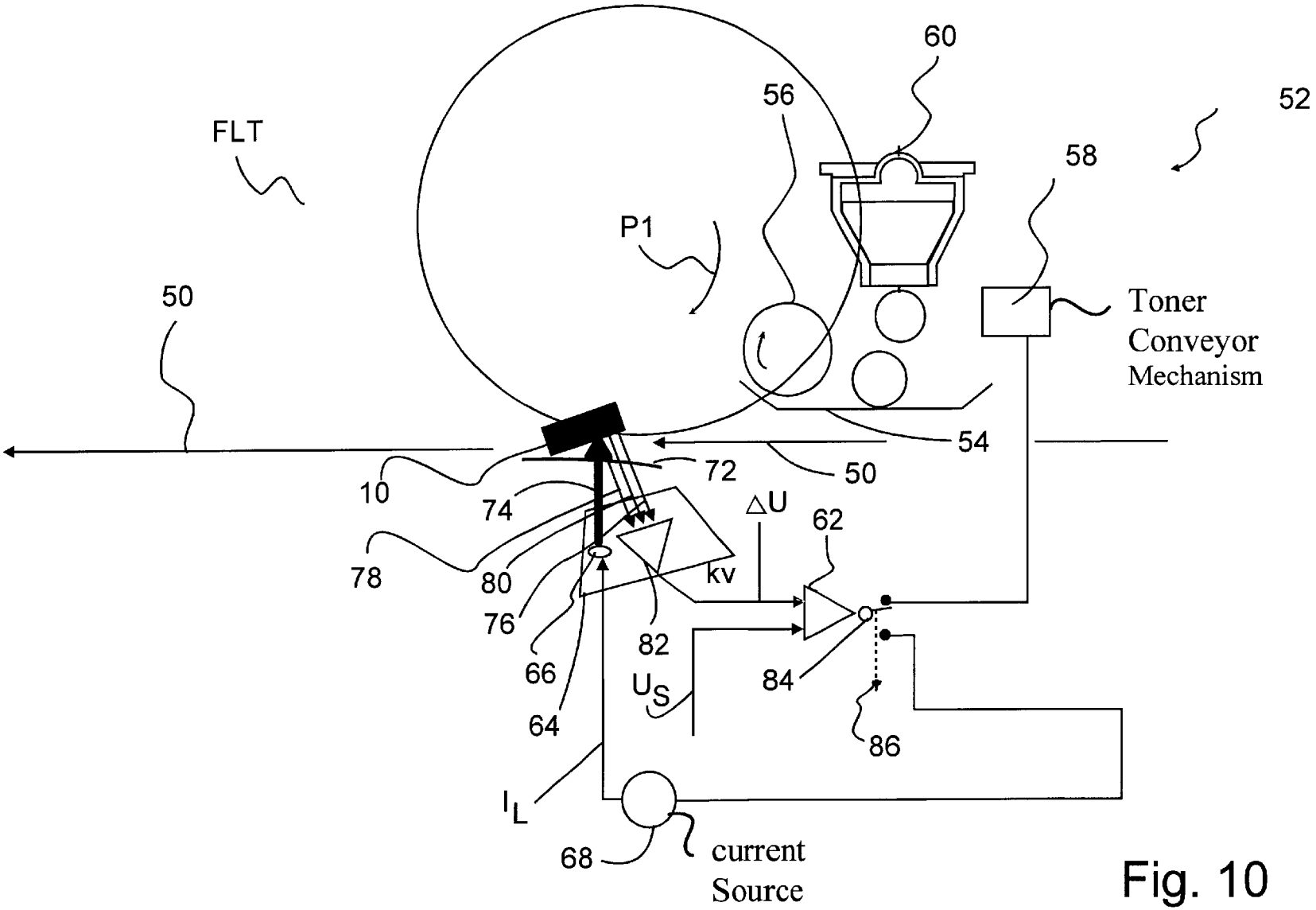
FIG. 10 is schematic side view of the structure of a printing device in which the invention is realized.

FIG. 10 shows the schematic structure of a printing device in which the invention is realized. A photoconductive drum FLT rotates in the printing process in the direction of the arrow P1, whereby a toner image is printed on individual pages 50. A developer station 52 contains a receptacle 54 in which the developer mixture of toner and carrier is prepared. A developer drum 56 transfers the toner onto the surface of the photoconductive drum FLT. The photoconductive drum FLT and the developer station 52 function according to the principle of counter-directional development; that is, the directions of rotation of the developer drum 56 and the photoconductive drum FLT are opposite one another. The developer station 52 also includes a toner conveyor mechanism 58, which feeds apportioned toner from a stock receptacle to a toner cross-conveyor 60. This toner cross-conveyor 60 delivers the toner to the receptacle 54. The toner conveyor mechanism 58 contains a drive motor, which is switched into the operative state ON or OFF by a two-position controller 62.

A toner mark 10 is provided on the photoconductive drum FLT, which mark is scanned using a reflex sensor 64. This reflex sensor 64 contains an LED 66, which emits monochromatic infrared radiation. The advantage of using infrared radiation is that this radiation reacts less sensitively to the different toner colors, so that its reflection power enters less significantly into the result. Besides, it is possible to suppress unwanted white light more effectively using infrared light. The LED 66 is powered with the current $I_L$ from a controllable current source 68. Between the photoconductive drum FLT and the reflex sensor 64, a glass covering 72 is arranged, which prevents contamination by toner particles. The emitted radiation bundle 74 is reflected various ways. The reflected radiation is composed of a portion 76, which originates at the surface of the photoconductive drum FLT. Another radiation portion 78 is produced by reflection at the glass covering 72. Finally, still another radiation portion 80 is produced, which originates from the reflection at the toner particles. The overall radiation that is reflected by the toner mark 10 is detected by a receiving device 82, which contains a reception diode. The receiving device 82 forms the value ΔU=Ua2−Ua1.

The value ΔU is compared to a desired value Us at the controller 62. When ΔU is greater than Us, the toner transport mechanism 58 is switched on, and toner is continuously conveyed until the deviation between ΔU and Us is controlled to approximately zero.

During an adjustment phase, the switch 84 is switched in the direction of the arrow 86, whereby the controllable current source 68 is actuated via the controller 62. In this adjustment phase, a scaling is performed to the reflection power of the black surface of the photoconductive drum FLT. Here, the black surface of the photoconductive drum FLT is irradiated by the reflex sensor 64, and the appertaining voltage value U is measured in the receiving device 82. The controllable current source 68 is now adjusted such that a constant maximum value Um sets in in the receiving device 82. The toner mark 10 is then scanned later with this setting. What is achieved by this procedure is that the reflection power of the surface of the photoconductive drum is not so great a factor in the result, because the variable reflection behavior is scaled to the value Um. The values ΔU of different photoconductive drums are thus largely constant given otherwise identical toner scanning. When the photoconductive drum FLT is replaced by another, the control of the toner concentration does not change. The described adjustment phase can also be repeated at time intervals in order to correct a change in reflection power of the surface of the photoconductive drum FLT.

A character generator (which is not illustrated) that is arranged in front of the developer station 52 transverse to the direction of rotation P1 of the photoconductive drum FLT writes the latent image or the latent images for one or more toner marks 10 on the surface of the photoconductive drum FLT. The line generator and the reflex sensor 64 are generally detachably installed, in which process tolerances arise. These can be summarized in that the distance along the perimeter of the photoconductive drum FLT between character generator and reflex sensor 64 typically fluctuates up to 2 mm. A time control is typically used for the scanning of the toner marks 10. At the start of the writing of the latent image by the character generator, a starting time is specified. On the basis of the constant rate of rotation of the photoconductive drum FLT and of the known distance between line generator and reflex sensor 64, a delay time tm is computed, from which the scanning instant for the toner mark 10 by the reflex sensor 64 derives.

Figure 11:
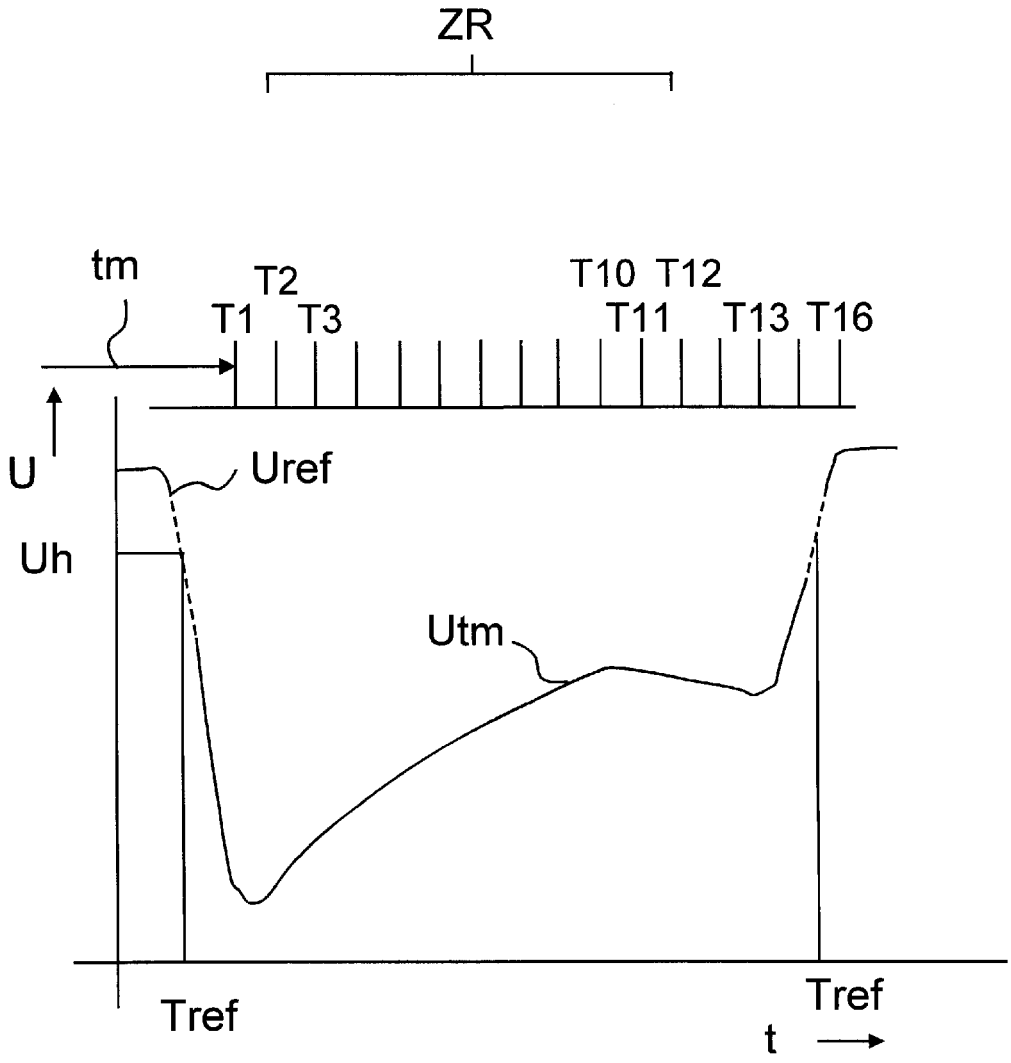
FIG. 11 is a graph of raster time at which the curve of the sensor voltage is scanned over the length of the toner mark and stored.

FIG. 11 shows the voltage curve U when the toner mark 10 passes the reflex sensor 64. The curve corresponds to that according to FIG. 1. The toner mark 10 is scanned at times T1 and T16 within a time frame ZR. At each raster time T1 to T16 four scan values are obtained, which are fed to a computer control as digital values. The average value of the 16 scan values that are acquired at each time T1 to T16 is then used as average scan value. The average scan values are temporarily stored in a memory.

The time frame ZR begins at raster time T1 when the delay time tm expires. In the method described above, averaged scan values for the times T4 to T7 and T10 to T13 are acquired as measurement values from which the difference, or respectively, quotient is calculated. The averaged scan values for the times T4 to T7 and T10 to T13 are in turn averaged in order to filter out the significant noise portion in the signals by average value formation. The values thus obtained for the measurement locations a1 and a2 are then processed.

As stated, the front edge 10*a* or the back edge 10*b* of the toner mark 10 is used as a reference point for detecting the position of the toner mark 10. When the beam spot of the reflex sensor 64 impinges on this front edge 10*a* or back edge 10*b* in halves, then the voltage Uh is at least approximately $$Uh=(Uref-Utm)/2,$$

where Uref is the voltage given reflection of the radiation at the blank photoconductive drum FLT, and Utm is the voltage given reflection at the toner mark 10 at the times T10 to T13.

In order to calculate the time Tref appertaining to the voltage Uh either at the front edge 10*a* or back edge 10*b* of the toner mark 10, the time frame Zr is shifted with respect to the delay time tm, and the voltage U is respectively sampled at a time T1. This shift occurs iteratively per toner mark by a time interval between the times T1 and T2. The number of shift steps required for determining the voltage Uh then indicates the amount by which the delay time tm must be corrected in order to scan the toner mark 10 at the measurement locations a1, a2, whose position has a definite distance from the front edge 10*a* or back edge 10*b* of the toner mark 10. The scanning is selected at time T1 because later times may vary chronologically owing to interrupt run times of the interrupt-controlled generation of the times T1 to T16. It should also be noted that in FIG. 11 the voltage curve U is reproduced in a vertically compressed state; the voltage Uref is significantly higher relative to the voltage Utm than is represented in the curve.

Figure 12:
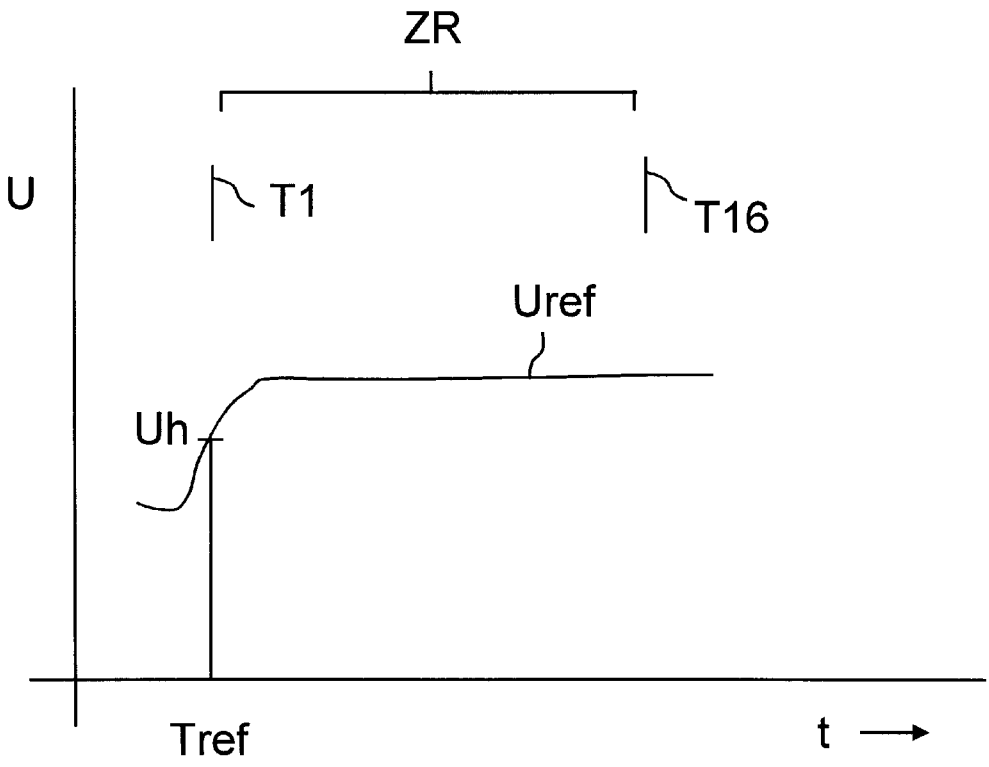
FIG. 12 is a graph of the scanning process, when the back edge of the toner mark passes the reflex sensor.

FIG. 12 shows a graph in which the time frame ZR has been shifted up to time T1 to calculate the voltage Uh. The number of shift cycles that are required for discovering the voltage Uh is a measure of the amount of delay time tm by which to correct in order to scan the toner mark 10 or marks at the predetermined measurement locations a1 and a2.

The described method for fixing the exact position of the toner mark 10 is applied with every initial adjustment of the printer or copier. In this adjustment process, a number of toner marks are printer on the photoconductive drum FLT in order to achieve a high precision in the adjustment. The cited steps can also be applied at predetermined time intervals, for instance at intervals of one hour operating time, or after each new activation of the printer or copier ( after each new set up).

The described exemplifying embodiment can be modified in the scope of the invention. For instance, the sensor 64 can scan the toner mark 10 after the print transfer onto a carrier material, for instance paper. In this case, normalization can take place with reference to the reflex power of the carrier material. In another variant, a photoconductive strip can be used instead of a drum. Black toner material, colored toner material, a toner that is mixed together from toner materials with different primary colors, or a transparent toner material can be used here. This variant is described in published PCT international patent application WO98/39691 A1, for example. The contents of this WO publication are hereby incorporated into the present specification by reference.

Although other modifications and changes may be suggested by those skilled in the art, it is the intention of the inventors to embody within the patent warranted hereon all changes and modifications as reasonably and properly come within the scope of their contribution to the art.

We claim:

1. A device for electrographic printers or copiers, comprising:

a toner carrier on which a latent image is generated;

a developer station for inking the latent image with toner, said developer station containing a developer mixture of toner and carrier with an adjustable proportion of toner;

at least one toner mark inked with toner for monitoring and adjusting toner surface coverage;

at least one sensor to scan the at least one toner mark that has been provided with toner at at least two measurement locations that are situated consecutively as seen in a direction of motion of said toner carrier, said at least one sensor forming electrical signals corresponding to respective surface coverage at said at least two measurement locations;

said at least one toner mark having a toner supply over a length of the toner mark that falls or rises in one section and is constant in another section;

at least one of the measurement locations being located in the one section with falling or rising toner supply;

a toner proportion adjuster with which a proportion of toner in the developer mixture is adjusted depending on a difference or a quotient of absolute values of the signals at said at least two measurement locations, said toner proportion adjuster comparing at least one of the difference and the quotient to a desired value;

a toner transport mechanism operable to feed toner to said developer station; and a controller connected to actuate said toner transport mechanism which feeds toner to the developer station.

2. A device as claimed in claim 1, wherein said at least one toner mark is provided on at least one of said toner carrier and a carrier material, and said at least one sensor is mounted to scan said at least one toner mark that has been provided with toner.

3. A device as claimed in claim 1, wherein said controller is a two-position controller.

4. A device as claimed in claim 1, wherein a fraction of a value of the signal is prescribed as said desired value, said fraction being generated by reflection at a surface of one of said toner carrier and of a carrier material.

5. A device as claimed in claim 1, wherein a first measurement location of said at least two measurement locations is located within a first third of a length of said at least one toner mark as seen in the direction of motion of said toner carrier.

6. A device as claimed in claim 1, wherein a second measurement location of said at least two measurement locations is located within a last third of a length of said at least one toner mark as seen in the direction of motion of said toner carrier.

7. A device as claimed in claim 1, wherein said at least one sensor includes a reflex sensor.

8. A device as claimed in claim 7, wherein said reflex sensor emits monochromatic infrared radiation.

9. A device as claimed in claim 1, wherein said at least one sensor includes a capacitive sensor.

10. A device as claimed in claim 1, wherein said toner proportion adjustment averages signals over several toner marks, and an average difference of the averaged signals is used as the difference of the signals at said at least two measurement locations.

11. A device as claimed in claim 1, wherein said toner is one of black toner, colored toner, and a toner that is mixed together from toner materials with primary colors and a transparent toner.

12. A method for electrographic printing or copying, comprising the steps of:

generating a latent image on a toner carrier;

inking a developer station the latent image with toner, said developer station containing a developer mixture of toner and carrier with an adjustable proportion of toner;

inking at least one toner mark on the toner carrier with toner for monitoring and adjusting toner surface coverage;

scanning the toner marks that have been provided with toner by at least one sensor at at least two measurement locations that are situated consecutively as seen in a direction of motion of the toner carrier, and forming electrical signals from the respective surface coverage at said at least two measurement locations;

a toner supply over a length of the toner mark falling or rising in one section and being constant in another section at least one of said at least two measurement locations being located in the section with falling or rising toner supply;

adjusting a proportion of toner in the developer mixture depending on a difference or a quotient of absolute values of the signals at said at least two measurement locations;

comparing the difference or the quotient to a desired value; and actuating a transport mechanism which feeds toner to the developer station depending on said comparing step.

13. A method as claimed in claim 12, wherein said scanning step includes scanning toner marks that have been provided with toner on at least one of the toner carrier and a carrier material.

14. A method as claimed in claim 12, wherein said step of actuating is performed by a two-position controller.

15. A method as claimed in claim 12, wherein a first measurement location of said at least two measurement locations is located within a first third of a length of the toner mark as seen in the direction of motion of the toner carrier.

16. A method as claimed in claim 12, wherein a second measurement location of said at least two measurement locations is located within a last third of a length of the toner mark as seen in the direction of motion of the toner carrier.

17. A method as claimed in claim 12, wherein said scanning step is performed using a reflex sensor.

18. A method as claimed in claim 12, further comprising the step of:

averaging signals over several toner marks, and an average difference of the averaged signals or an average quotient of the averaged signals being used as the difference.

19. A method as claimed in claim 12, wherein said toner is selected from the group consisting of: black toner, colored toner, a toner that is mixed together from toner materials with primary colors, and a transparent toner.

20. A device for electrographic printing or copying, comprising:

a toner carrier on which a latent image is generated;

a developer station which inks the latent image with toner, said developer station containing a developer mixture of toner and carrier with an adjustable proportion of toner;

at least one toner mark inked with toner for monitoring and adjusting toner surface coverage;

at least one sensor which scans said at least one toner mart at at least two measurement locations that are situated consecutively as seen in a direction of motion of the toner carrier, said at least one sensor forming electrical signals corresponding to respective surface coverage at said at least two measurement locations;

a control device connected to said at least one sensor to process said electrical signals;

a toner supply over the length of the toner mark falling or rising in one section and being constant in another section;

at least one of said at least two measurement locations being located in the one section with falling or rising toner supply; and a reference time at which a reference point on the toner mark passes said at least one sensor, and scanning at said at least two measurement locations occurs relative to said reference time.

21. A device as claimed in claim 20, wherein said reference point is one of a front edge and a back edge of the toner mark.

22. A device as claimed in claim 20, wherein said at least one sensor includes a scanning sensor.

23. A method as claimed in claim 12, wherein said step of scanning at said at least two measurement locations occurs after a predetermined delay time which expires after a time at which writing of the toner mark occurs.

24. A method as claimed in claim 23, wherein said delay time is varied depending on the reference time.

25. A method as claimed in claim 12, further comprising the step of:

fixing the reference time when the electrical signal of the scanning sensor is approximately equal to the relation $$Uh=(Uref-Utm)/2,$$

where Uref is the voltage given reflection of the radiation at the blank photoconductive drum, and Utm is the voltage given reflection at the toner mark.

26. A method as claimed in claim 12, wherein said step of scanning utilizes monochromatic infrared radiation.

27. A method as claimed in claim 12, further comprising the steps of:

acquiring several scan values at each measurement location; and forming an average value from said several scan values, said average value being is processed.

28. A method for electrographic printing or copying, comprising the steps of:

generating a latent image on a toner carrier;

inking the latent image with toner in a developer station, said developer station containing a developer mixture of toner and carrier;

inking at least one toner mark on the toner carrier with toner for monitoring and adjusting toner surface coverage;

scanning said at least one toner mark by at least one sensor at at least two measurement locations that are situated consecutively as seen in a direction of motion of the toner carrier to form electrical signals corresponding to respective surface coverage at said at least two measurement locations, which are processed by a control;

a toner supply over a length of the toner mark falling or rising in one section and being constant in another section;

locating at least one of said at least two measurement locations in the section with falling or rising toner supply;

defining a reference time at which a reference point on the toner mark passes said at least one sensor; and said scanning step occurring at said at least two measurement locations occurs relative to said reference time.

29. A method as claimed in claim 28, wherein said step of defining said reference time uses a front edge or back edge of the toner mark is used as said reference point.

30. A method as claimed in claim 28, wherein said scanning step utilizes a scanning sensor.

31. A method as claimed in claim 28, wherein said step of includes scanning at said at least two measurement locations occurs after a predetermined delay time, which expires after a time at which writing of the toner mark occurs.

32. A method as claimed in claim 31, further comprising the step of:

varying the delay time depending on the reference time.

33. A method as claimed in claim 28, wherein the reference time is fixed when the electrical signal of the scanning sensor is approximately equal to the relation $$Uh=(Uref-Utm)/2,$$

where Uref is the voltage given reflection of the radiation at the blank photoconductive drum, and Utm is the voltage given reflection at the toner mark.

* * * * *